US012687356B2

(12) United States Patent
Hummel et al.

(10) Patent No.: US 12,687,356 B2
(45) Date of Patent: Jul. 21, 2026

(54) BASE RECOVERY DEVICE AND GUN EQUIPPED WITH SUCH A DEVICE

(71) Applicant: KNDS FRANCE, Versailles (FR)

(72) Inventors: Boris Hummel, Bourges (FR); Maxime Collard, Bourges (FR); Antoine Latroye, Bourges (FR)

(73) Assignee: KNDS FRANCE, Versailles (FR)

( * ) Notice: Subject to any disclaimer, the term of this patent is extended or adjusted under 35 U.S.C. 154(b) by 0 days.

(21) Appl. No.: 18/991,849

(22) Filed: Dec. 23, 2024

(65) Prior Publication Data

US 2025/0207878 A1 Jun. 26, 2025

(30) Foreign Application Priority Data

Dec. 26, 2023 (FR) ..... 2315185

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 89/33.4
See application file for complete search history.

(56) References Cited

U.S. PATENT DOCUMENTS 2,865,254 A * 12/1958 Aldrin ..... F41A 9/11 89/45
3,238,844 A * 3/1966 Carlsson ..... F41A 9/56 89/33.4
3,417,658 A * 12/1968 Betzold ..... F41A 9/54 89/33.4
3,640,177 A * 2/1972 Hottinger ..... F41A 9/54 89/33.4
3,988,962 A * 11/1976 Elwin ..... F41A 9/54 89/46
8,555,767 B2 10/2013 Ahn et al.

FOREIGN PATENT DOCUMENTS

FR 2613235 A1 10/1988
FR 2714158 A1 6/1995

OTHER PUBLICATIONS

Sep. 17, 2024 Search Report and Written Opinion issued in French Patent Application No. 2315185.

* cited by examiner

*Primary Examiner* — Bret Hayes
(74) *Attorney, Agent, or Firm* — Oliff PLC

(57) ABSTRACT

A base recovery device and a gun equipped with such a device includes a structure extendable between a non-spread out state and a spread out state and having a base-receiving opening delimited by first and second arms parallel to each other, at least one lever which pivots and supports the second arm, and a mechanism for moving the lever. The mechanism includes an actuating member, a drive assembly and a clutch assembly arranged such that at least one lever is automatically moved to an unfolded position, in which the structure is in the spread out state, when the breechblock is moved from closed position to open position during the gun recovery stroke, and such that at least one lever is automatically moved to a folded up position, in which the structure is in the non-spread out state, before the end of the recovery stroke and independently of the breechblock movement.

9 Claims, 8 Drawing Sheets

[Fig. 1]
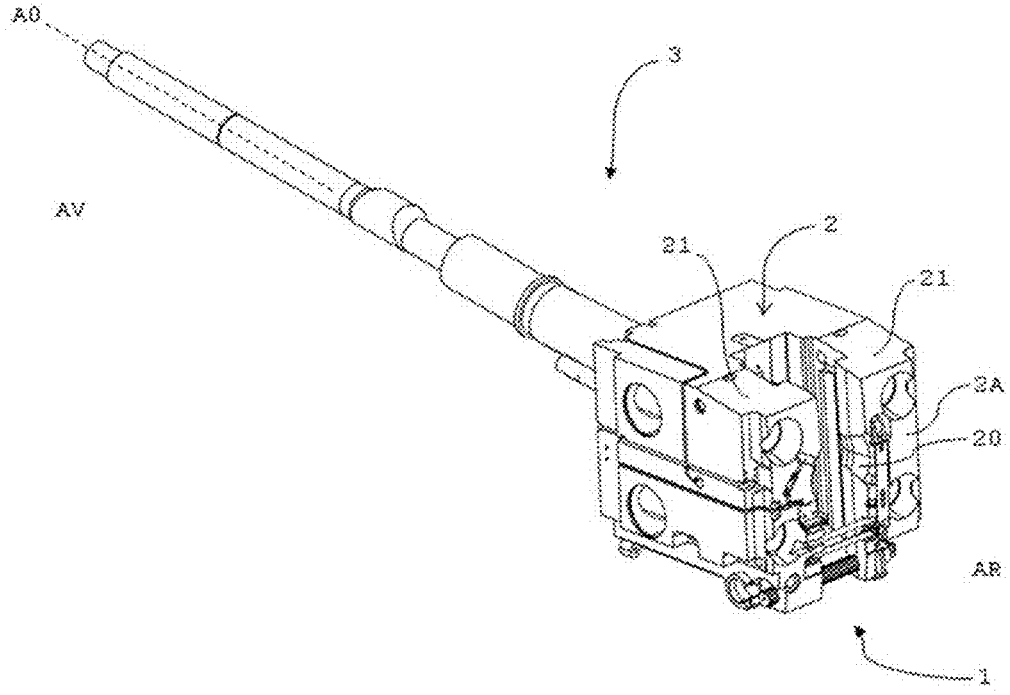

[Fig. 2]
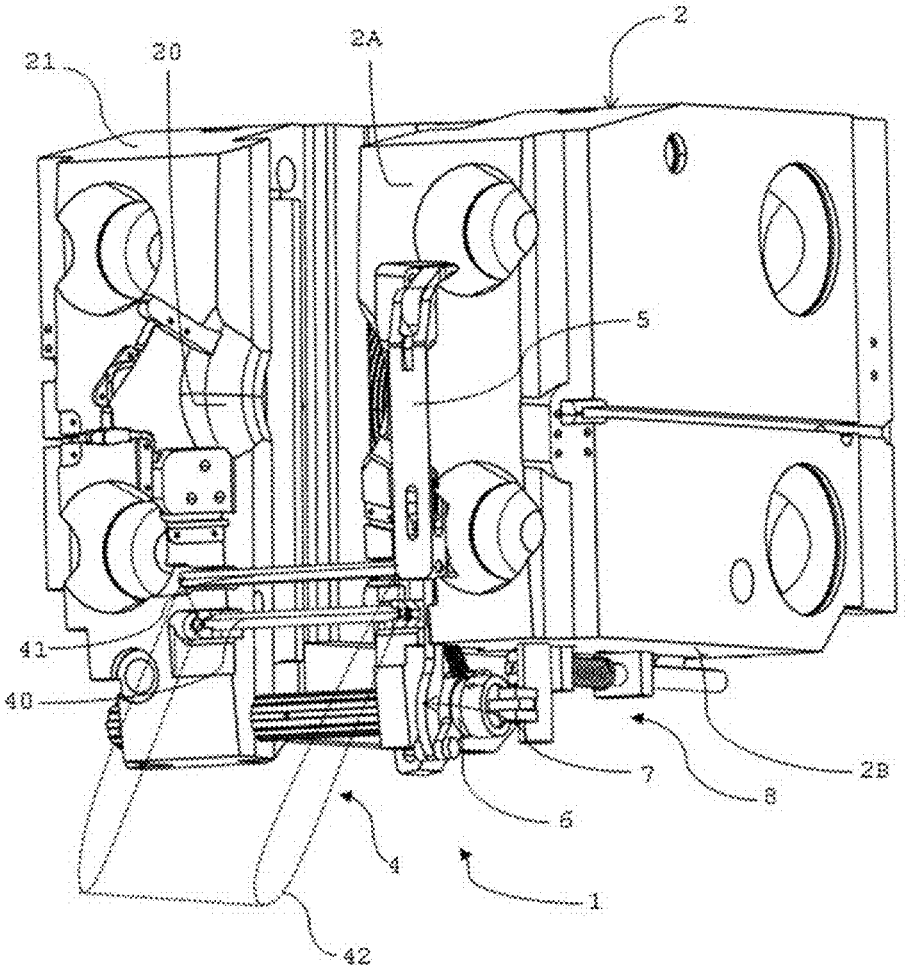

[Fig. 3]
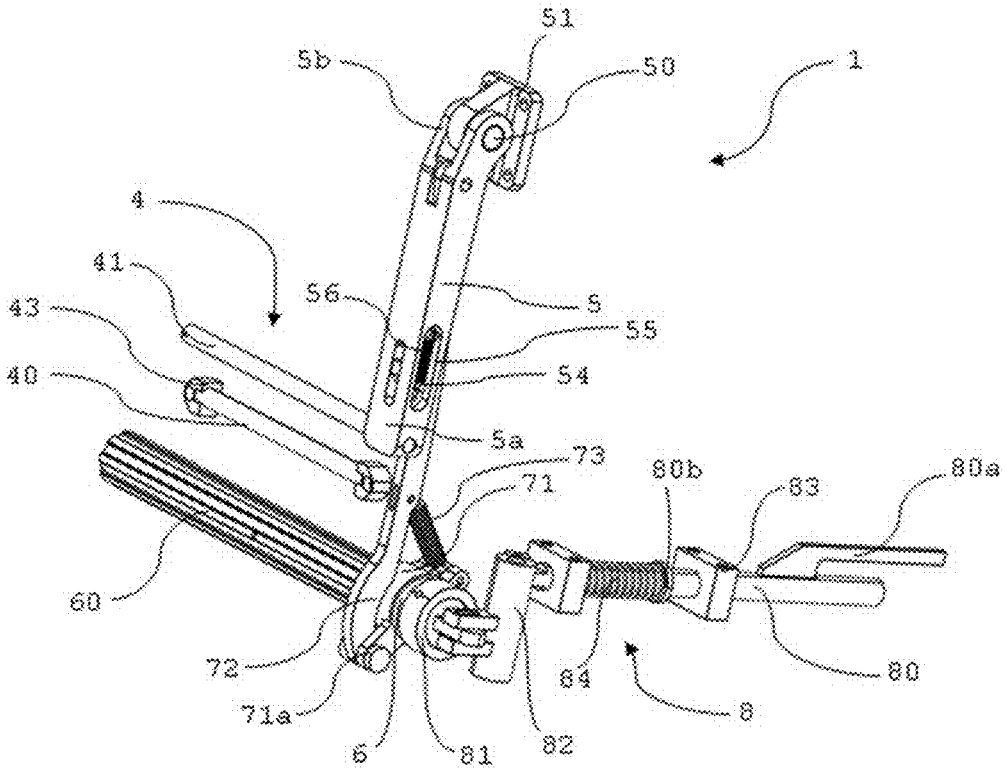

[Fig. 4]
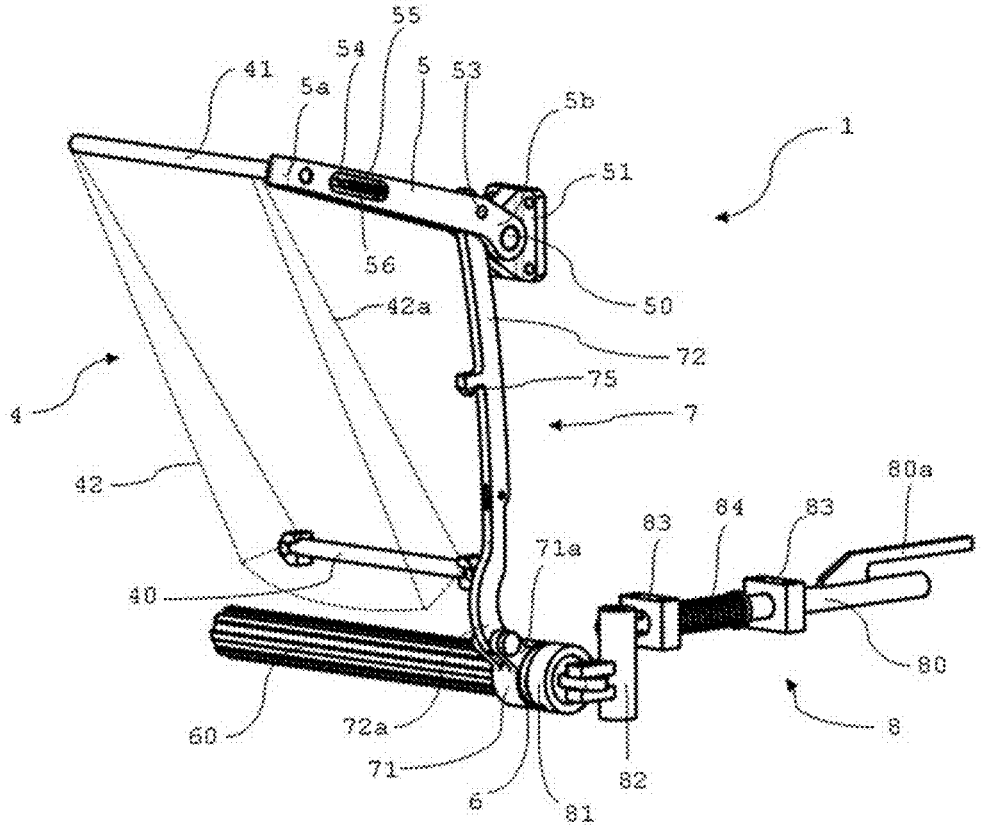
[Fig. 5]
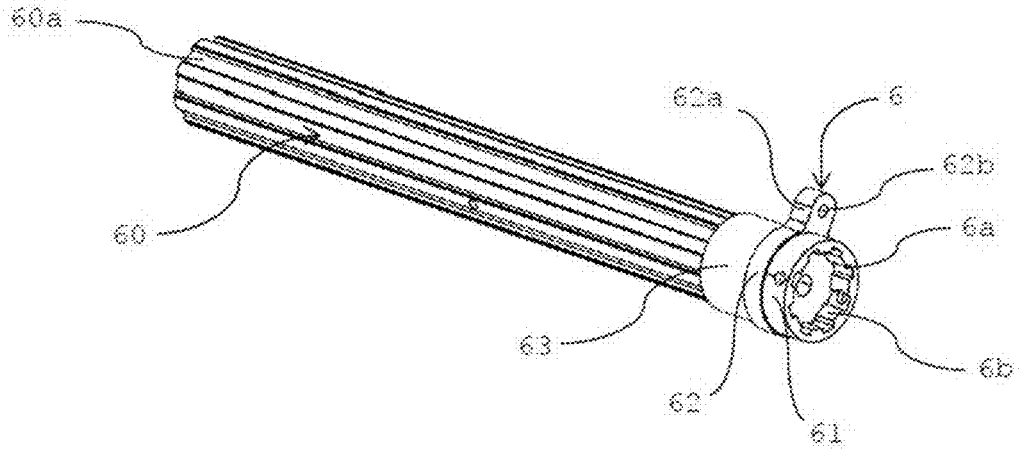

[Fig. 6]
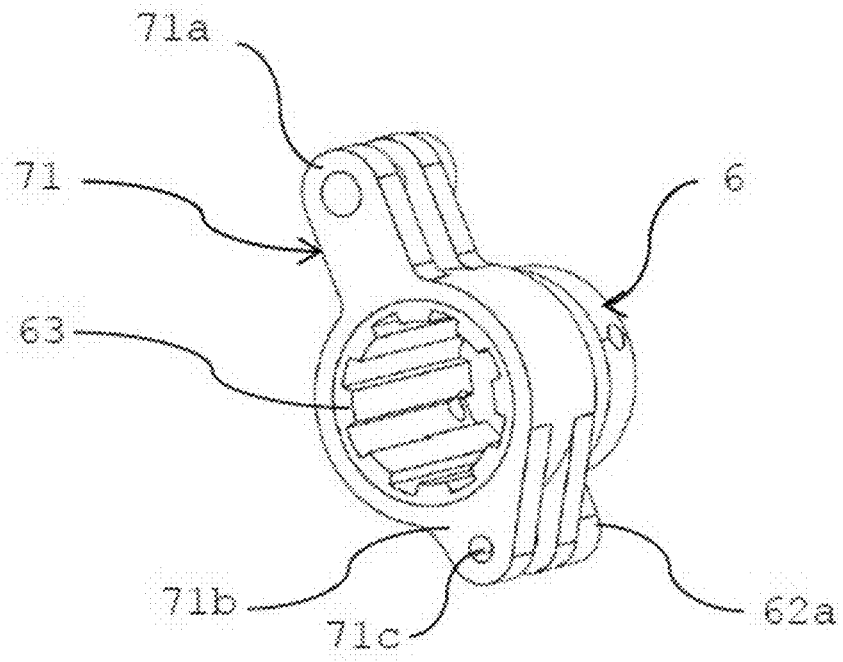

[Fig. 7]
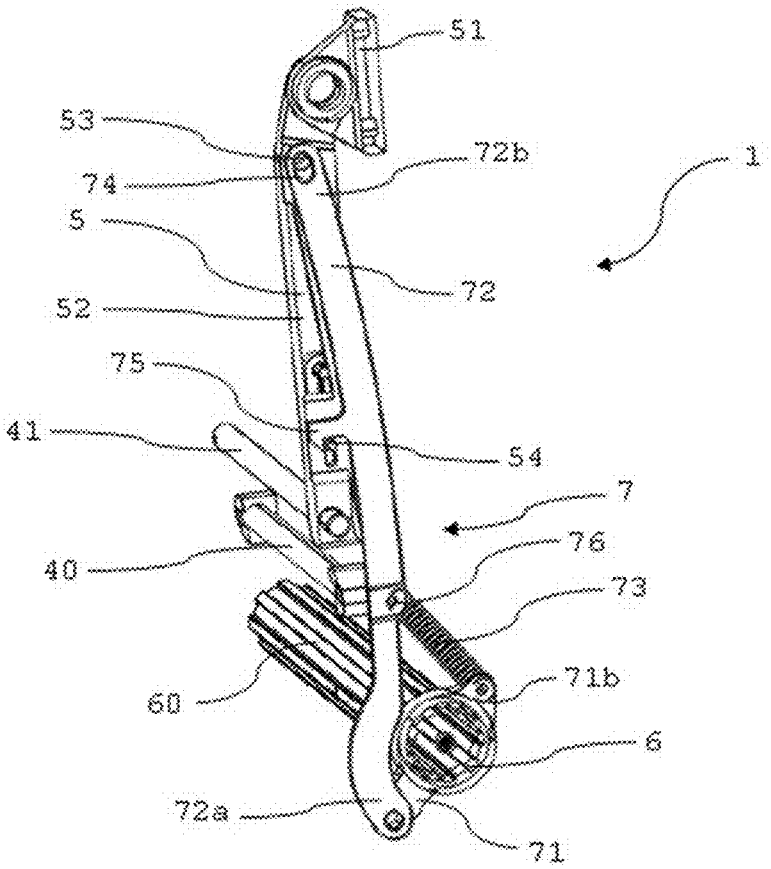
[Fig. 8]
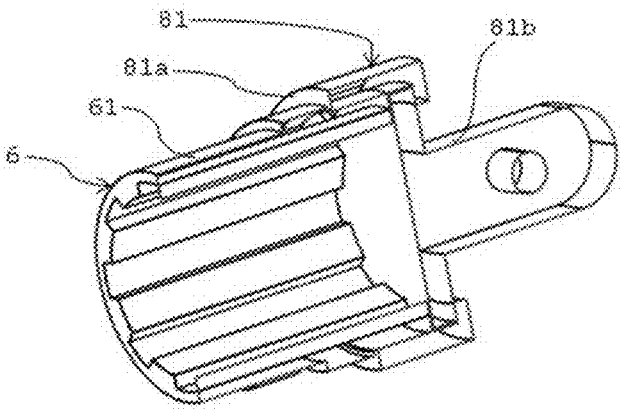

[Fig. 9]
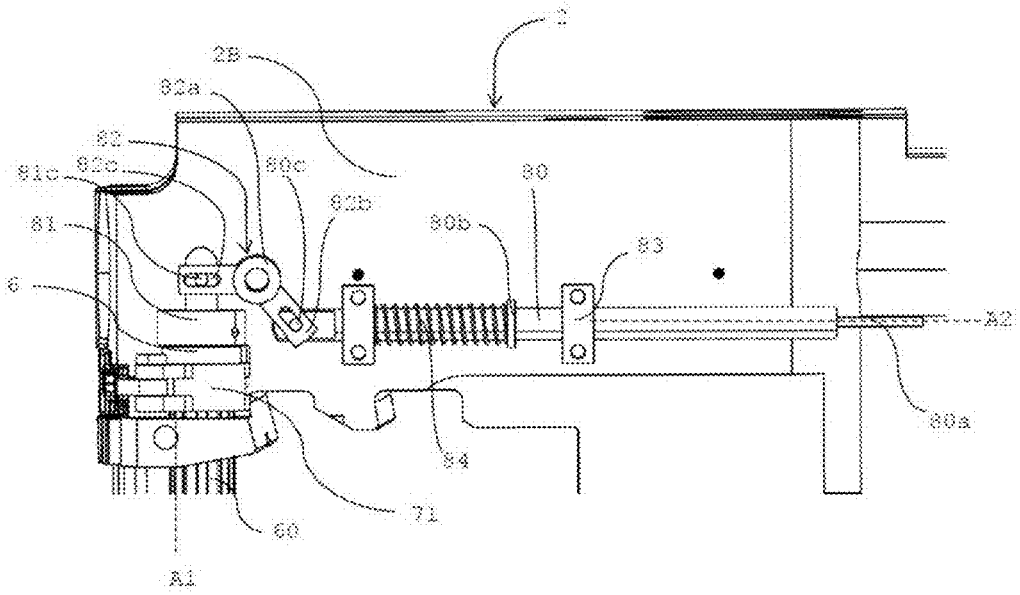
[Fig. 10]
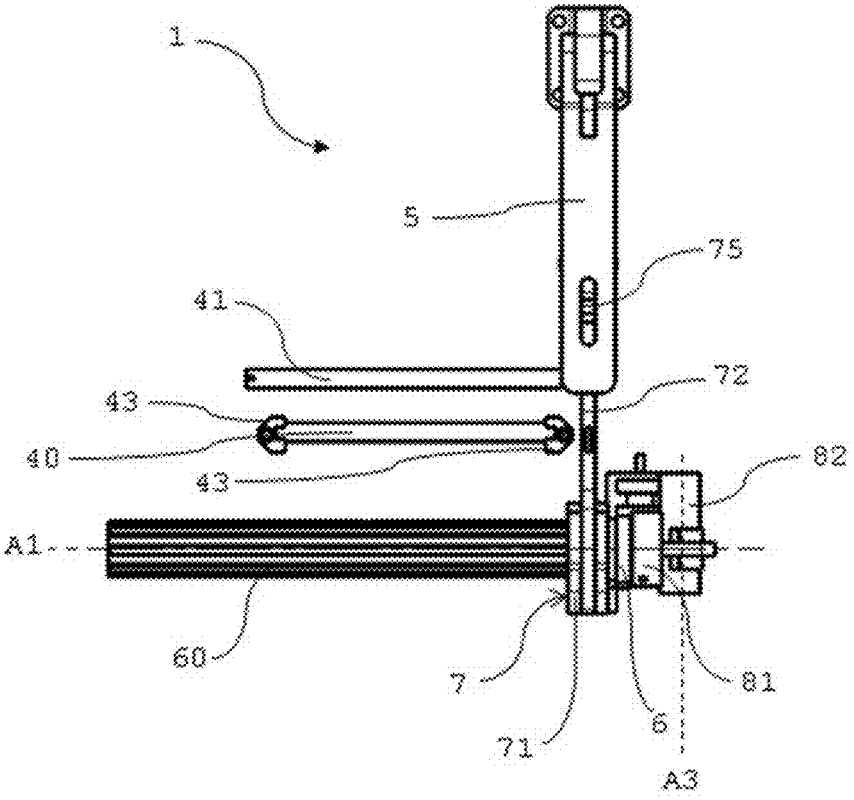

[Fig. 11]
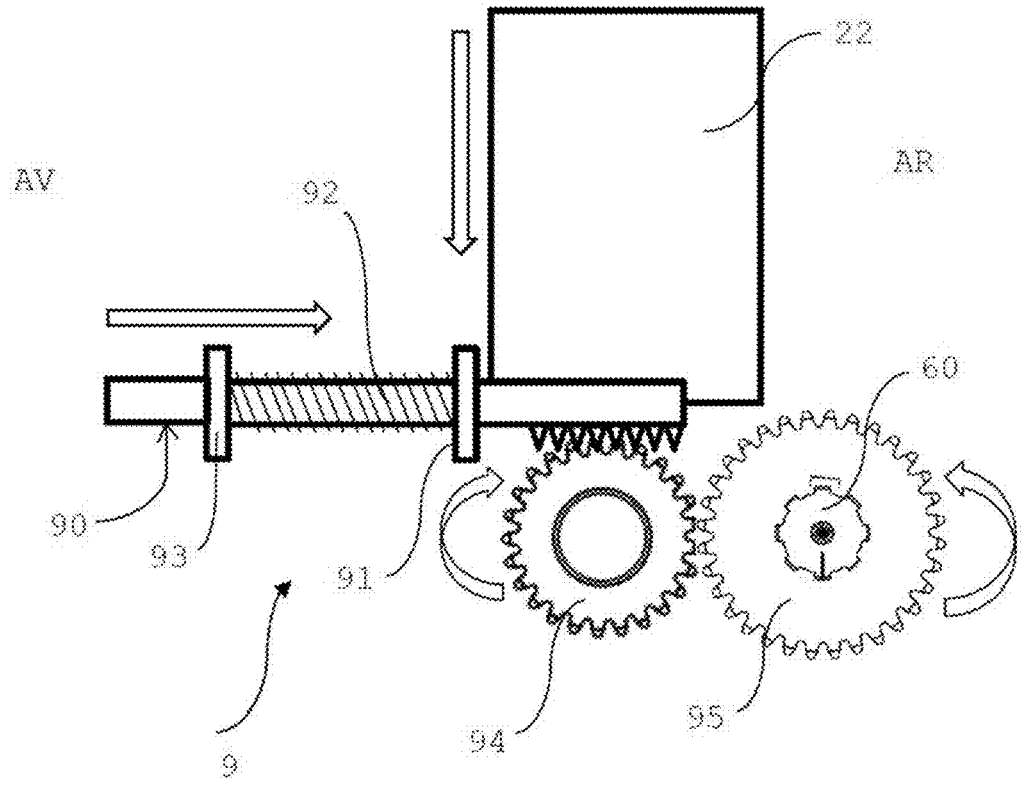

BASE RECOVERY DEVICE AND GUN EQUIPPED WITH SUCH A DEVICE

The technical field of the invention is that of base recovery devices, in particular devices for recovering bases of large-caliber ammunition for guns comprising a breech system with a breech ring and a breechblock that can slide relative to the breech ring, in particular for tank guns.

It should be emphasized that the recovery device according to the present invention is not limited to the recovery of bases, but could also be used for the recovery of any non-combustible part of the round of ammunition, such as a case.

When a round of ammunition is fired from a tank-type gun, a projectile is expelled from a barrel of the gun and a base is ejected from an ejection port on the gun.

In order to prevent the bases from accumulating in the vicinity of the ejection port, which could lead to a firing incident caused by clogging, it is known to use a base recovery device.

For example, the base recovery device disclosed in French patent FR2,613,235 is known. This device comprises a recovery bag made of reinforced fabric, which is positioned behing the breech ring. The bag must be removed manually after firing and recovery of the base, to allow a new round of ammunition to be inserted into the gun, and then put back in place again manually before firing.

This system however requires human intervention and the manual steps of inserting and removing the recovery bag are time-consuming. As a result, such a device is not suitable when the turret is equipped with automatic loading means and a high rate of fire is required.

U.S. Pat. No. 8,555,767 provides a device for recovering ammunition bases which operates automatically, without any human intervention. The device comprises a base recovery bag carried by two movable upper arms and two movable lower arms, such that the bag is placed in a spread out state or in a non-spread out state by the movement of the breech ring. When the bag is in its non-spread out state, the device is retracted under the gun.

However, when not in use, in other words when retracted, such a device significantly encroaches into the volume surrounding the gun. This encroachment is not compatible with confined environments that for example may be encountered in a vehicle turret.

The present invention therefore aims to provide a solution which makes it possible to maintain high rates of fire by rapidly unfolding and removing the base recovery device in masked time during firing, and which therefore makes it possible to recover bases from ammunition fired in a gun fed by means of an automatic loading device that allows a very short time interval between two successive shots. Another aim of the present invention is to provide a recovery device which operates automatically and is adjustable in relation to the firing sequence of the gun, without any human intervention. Yet another aim of the present invention is to provide a solution that takes up less space than the solutions of the prior art, and therefore limits the size required for unfolding and removing the device. Finally, the present invention aims to propose a low-cost solution, as the recovery device does not require the addition of an actuator.

The present invention relates to a device for recovering ammunition bases for a gun of the type including a breechblock movable in a breech ring between a closed position, in which the breechblock closes off a chamber, and an open position, in which said chamber is open to receive a round of ammunition, which device includes:

a structure extendable between a non-spread out state and a spread out state, the extendable structure having a base-receiving opening intended to be located opposite the chamber in the spread out state and not to be located opposite the chamber in the non-spread out state, the base-receiving opening being delimited by a first arm intended to be connected to the breech ring and a second arm parallel to the first arm;

at least one lever rotatable about a pivot pin parallel to the first and second arms and intended to be connected to the breech ring, the at least one lever supporting the second arm; and a mechanism for moving the at least one lever, arranged to place the at least one lever in a folded up position, in which the structure is in the non-spread out state, and in an unfolded position, in which the structure is in the spread out state, characterized in that the movement mechanism includes:

an actuating member able to be moved in translation and rotation, the rotational movement being intended to be controlled by a system for controlling the movement of the breechblock;

a drive assembly connected to the at least one lever and able to move the at least one lever in rotation about its pivot pin as a result of a rotation of the actuating member; and a clutch assembly intended to be carried by the breech ring and able to adopt a coupling position, in which the actuating member and the drive assembly are coupled in rotation, and a decoupling position, in which the actuating member and the drive assembly are uncoupled, the clutch assembly being arranged to be placed in the coupling position during the phase of recovery stroke of the gun, during which the breechblock is moved from its closed position to its open position, whereby the at least one lever is moved to its unfolded position by the drive assembly to enable the ejection of a base into the extendable structure in the spread out state once the breechblock is in its open position, and to be placed in the decoupling position as the end of the recovery stroke of the gun approaches, whereby the at least one movable lever is then moved to its folded up position by the action of return means, independently of the movement of the breechblock.

Such a device enables the bases to be recovered automatically and in masked time during firing. As a result, with such a device, no human intervention is required to recover the bases and the rate of fire is not reduced, as the gun can be reloaded after the recovery stroke. In addition, as the device is configured to be indexed, on the one hand, to the movement of the breechblock and, on the other hand, to the movement of the breech ring, no additional actuator is required, making it possible to obtain a low-cost device.

Advantageously, the recovery device comprises a single lever, a distal end of which is integral with the second arm and a proximal end of which is connected to the pivot pin, the lever and the second arm being perpendicular to each other.

Such a single-lever kinematics takes up very little space.

In a particular embodiment, the actuating member is a piece mounted so as to be movable in translation along a rotary cylinder intended to be connected to the breech ring so as to be able to rotate about about a rotation axis parallel to the pivot pin, the rotation of the rotary cylinder being intended to be controlled by the system for controlling the movement of the breechblock, said piece being coupled in rotation to the rotary cylinder and including:

a first connecting part connected to the clutch assembly such that said piece is movable in translation along the rotary cylinder by movement of the clutch assembly between the coupling and decoupling positions, but that a rotation of said piece about the rotation axis is not transmitted to the clutch assembly;

a second connecting part having a tab carrying a member for coupling in rotation to the drive assembly when the clutch assembly is in the coupling position; and a third connecting part around which the drive assembly is mounted so as to allow a relative rotation between the actuating member and the drive assembly when the clutch assembly is in the decoupling position.

Preferably, the clutch assembly includes:

a pushing element intended to be connected to the breech ring and mounted so as to be movable in translation along a push direction orthogonal to the longitudinal direction of the first and second arms and parallel to the plane in which the at least one lever pivots;

a coupling element integral in translation with the actuating member; and an intermediate element connected on the one hand to the pushing element and on the other hand to the coupling element, and arranged to convert a translational movement of the pushing element toward the coupling element into a translational movement of the coupling element, and therefore of the actuating member, away from the drive assembly, and vice versa, the coupling element also being arranged to prevent any transmission of rotation from the actuating member to the intermediate element.

Preferably, the drive assembly includes:

a first drive element configured to be coupled in rotation to the actuating member when the clutch assembly is in the coupling position;

a second drive element connected to the first drive element and cooperating with the at least one lever such that a rotation of the first drive element under the action of the actuating member causes a rotation of the at least one lever toward its unfolded position; and the return means connected to one of the first drive element and the second drive element, and arranged such that, when the clutch assembly is in the decoupling position, the return means urges the drive elements so as to cause a rotation of the at least one lever toward its folded up position.

The second drive element may have a locking hook arranged to engage the at least one lever when the at least one lever is in its folded up position.

The locking hook ensures that the at least one lever is held in the folded up position and thus that the extendable structure is held in the non-spread out state when the gun is ready to be loaded.

Advantageously, the extendable structure has an envelope made of flexible material in the form of a bag, the base-receiving opening being the only opening of the bag.

Alternatively, the extendable structure could be in the form of a chute having an upper opening constituted by the base-receiving opening and a lower opening oriented toward a base storage system.

In a particular embodiment, the first arm is a lower arm intended to be fixedly mounted with respect to the breech ring at a lower region of the cheeks of the breech ring that is located below the opening of the chamber, and the second arm is an upper arm, the first and second arms extending horizontally.

Alternatively, the first and second arms could be left and right arms extending vertically. In yet another variant, the first arm could be articulated relative to the breech ring, both the first and second arms being movable arms.

The present invention also relates to a large-caliber gun comprising a breechblock movable in a breech ring between a closed position, in which the breechblock closes off a chamber, and an open position, in which said chamber is open to receive a round of ammunition, characterized in that it is equipped with a device for recovering ammunition bases as defined above, the pivot pin of the at least one lever being positioned on a rear face of one of the cheeks of the breech ring, the rotation of the actuating member being controlled by a system for controlling the movement of the breechblock and the clutch assembly being carried by the breech ring.

To better illustrate the subject matter of the present invention, a particular embodiment will be described below, with reference to the attached drawings, in which:

FIG. 1 is a perspective view of a gun equipped with a base recovery device in accordance with the present invention;

FIG. 2 is an enlarged perspective view of the base recovery device according to the invention, mounted behind the breech ring, with the device being not unfolded;

FIG. 3 is a perspective view of the base recovery device according to the invention, with the device being not unfolded;

FIG. 4 is a perspective view of the base recovery device according to the invention, with the device being unfolded;

FIG. 5 is a detailed perspective view of the actuating member;

FIG. 6 is a detailed perspective view showing the cooperation between the actuating member and the first drive element in the coupling position;

FIG. 7 is a detailed perspective cross-sectional view along the longitudinal axis of the lever, showing the position of the drive assembly before the breechblock is opened;

FIG. 8 is a detailed perspective cross-sectional view in a plane passing through the longitudinal axis of the actuating member, showing the connection between the actuating member and the coupling element;

FIG. 9 is a bottom view, showing the clutch assembly in the coupling position;

FIG. 10 is a rear view of the device, showing the clutch assembly in the decoupling position; and FIG. 11 is a schematic view of the system for controlling the movement of the breechblock and the rotation of the rotary cylinder and the actuating member.

The base recovery device 1 according to the present invention, as illustrated in FIGS. 1 to 4, is intended to be mounted on a breech ring 2 of a gun 3. This breech ring 2 comprises, in a manner known per se, an ejection hole 20 in the extension of which the is located the chamber of the gun. Conventionally, a breechblock 22 (FIG. 11) can be moved vertically with respect to the breech ring 2 between a closed position, in which the breechblock 22 closes off the chamber, and an open position, in which said chamber is open. To load the gun 3, a round of ammunition is brought at the hole 20, in particular by an automatic loading device, and then inserted into the chamber. When the round of ammunition is fired, the breechblock 22 is in the closed position. After the round of ammunition has been fired, only the base remains in the gun chamber. The breech ring 2 then moves back before returning to its initial position. During this recovery stroke, the breechblock 22 is moved to its open position. Once the breechblock 22 is in the open position, the base is ejected through the ejection hole 20 with a certain velocity and must be recovered by the device 1 according to the present invention.

In order to recover the ejected base, the base recovery device 1 according to the present invention comprises an extendable structure 4, at least one lever 5 and a mechanism 6, 7, 8 for moving the at least one lever.

Referring to FIGS. 2 to 4, it can be seen that the extendable structure 4 can be placed in a spread out state and in a non-spread out state. In the spread out state (FIG. 4), the extendable structure 4 is opposite the ejection hole 20, in other words opposite the opening of the chamber, such that it is able to receive the ejected base. In the non-spread out state (FIG. 3), the extendable structure 4 is removed from the ejection hole 20 to allow a round of ammunition to pass through.

In the embodiment shown, the extendable structure 4 comprises a fixed lower first arm 40, a movable upper second arm 41 and an envelope 42 made of flexible material with a base-receiving opening 42*a* connected to the first 40 and second 41 arms.

The term "lower" used in the context of the present invention refers to an element intended to be located at a lower region of the breech ring 2 of the gun 3. The term "upper" refers to an element intended to be located above the lower element and able to be moved to an upper region of the breech ring 2 of the gun 3.

The first arm 40 is fixed to the rear face 2A of the breech ring 2, here by means of two arm supports 43, screwed to the breech ring 2 and each integral with one of the ends of the first arm 40. The two arm supports 43 are positioned opposite each other on the rear face 2A of each of the two cheeks 21 of the breech ring 2 and below the opening of the ejection hole 20, such that the first arm 40 extends between the two cheeks 21 in a direction orthogonal to the longitudinal axis A0 of the gun 3 and horizontally. Preferably, the first arm 40 is fixed in the vicinity of the lower edge of the breech ring 2 and is in the form of a tube.

The second arm 41, parallel to the first arm 40, is articulated with respect to the breech ring 2 by means of the at least one lever 5 to which it is fixed by one of its ends. The second arm 41 can also be integrally formed with the at least one lever 5. When the structure 4 is in the non-spread out state, the second arm 41 is positioned above the first arm 40, in other words between the first arm 40 and the base of the ejection hole 20, in the vicinity of the first arm 40 and in the same vertical plane as the first arm 40. When the structure 4 is in the spread out state, the second arm 41 is positioned above the opening of the ejection hole 20, in other words between the upper edge of the ejection hole 20 and the upper edge of the breech ring 2, and in a vertical plane parallel to the vertical plane that includes the first arm 40, in other words further away from the rear face 2A of the breech ring 2 than the first arm 40. The first 40 and second 41 arms substantially have the same length. Preferably, the second arm 41 is also in the form of a tube.

Alternatively, the first and second arms could be left and right arms extending vertically. In this case, the first arm must be positioned at a distance from the lateral edge of the opening of the ejection hole 20 such that, in the non-spread out state, the two arms are sufficiently far from the opening not to impede the passage of a round of ammunition toward the chamber. In yet another variant, the first arm could be articulated with respect to the breech ring 2, the first and second arms both being movable arms. For example, the first arm could be mounted so as to rotate freely relative to the breech ring 2 such that, in the non-spread out state, the first arm extends below the plane of the lower face 2B of the breech ring 2 and forward relative to the plane of the rear face 2A of the breech ring 2, and such that, in the spread out state, this first arm extends below the plane of the lower face 2B of the breech ring 2 and rearwards AR relative to the plane of the rear face 2A of the breech ring 2.

The envelope 42 made of flexible material, shown in dotted lines in FIGS. 2 and 4, is in the form of a bag with a single opening constituted by the base-receiving opening 42*a*. This opening 42*a* is delimited by at least one lower lip and one upper lip. The lower lip is connected to the first arm 40 by any appropriate fastener. The upper lip is connected to the second arm 41 by any appropriate fastener. The envelope 42 may be made of reinforced fabric or any other flexible material strong enough to prevent tearing when the base is ejected. Such an envelope 42 with a single opening 42*a* can be used to recover the ejected bases for storage. The envelope 42 collects the bases until it is completely full, then once full it is emptied to be ready to collect bases again.

The term "envelope made of flexible material" encompasses any unit capable of accommodating the bases and occupying both a spread out state and a non-spread out state.

Alternatively, the envelope 42 made of flexible material with a single opening 42*a* could be replaced by a chute having an upper opening constituted by the base-receiving opening and a lower opening oriented toward a system for storing bases. In this case, the chute recovers the bases in order to divert them to a remote storage system.

The at least one lever 5 is intended to connect the second arm 41 to the breech ring 2. In the preferred embodiment shown, the device 1 comprises a single lever 5 in order to reduce the size of the device 1. Thus, one of the ends of the second arm 41 is a free end, while the other end of the second arm 41 is integral with the lever 5.

The lever 5 is movable in a plane perpendicular to the rear face 2A of one of the cheeks 21 of the breech ring 2, and therefore in a plane perpendicular to the second arm 41.

The lever 5 has a distal end 5*a* with which the second arm 41 is integral and a proximal end 5*b* articulated with respect to the breech ring 2. In particular, the proximal end 5*b* of the lever 5 is integral with a pivot pin 50 parallel to the second arm 41 and which passes through the lever 5. This pivot pin 50 is rotatably mounted in a clevis 51 integral with the rear face 2A of the breech ring 2 and positioned in the vicinity of the upper edge of the opening of the ejection hole 20. Thus, the second arm 41 is movable relative to the breech ring 2 by rotation of the lever 5 about its pivot pin 50 between a folded up position and an unfolded position.

In the folded up position (FIGS. 1 to 3 and 7), the lever 5 is arranged against the rear face 2A of the breech substantially vertically, and the second arm 41 ring 2, extends below the opening of the ejection hole 20, in other words the extendable structure 4 is in the non-spread out state. In the unfolded position (FIG. 4), the lever 5 extends at a distance from the rear face 2A of the breech ring 2 and rearwards AR relative thereto in a plane forming an angle greater than 90 degrees relative to a vertical plane, and the second arm 41 extends above the opening of the ejection hole 20, in other words the extendable structure 4 is in the spread out state.

As it can be seen in FIG. 7, the lever 5 has a longitudinal groove 52 opening out on its face oriented toward the breech ring 2 in the folded up position. A lug 53 parallel to the pivot pin 50 passes through the end region of the groove 52 on the pivot pin 50 side. A pin 54 slidably mounted along the groove 52 passes through the end region of the groove 52 on the second arm 41 side. The pin 54 is oriented perpendicularly to the longitudinal axis of the lever 5 and parallel to the axis of the second arm 41, and is guided by its two ends each extending into a longitudinal notch 55 provided in a respective side wall of the lever 5. Each end of the pin 54 is connected to one end of an extension spring 56 extending parallel to the longitudinal direction of the lever 5 and the other end of which is connected to a pin integral with the lever 5, mounted closer to the lug 53 than the pin 54. The springs 56 therefore elastically urge the pin 54 in the direction toward the lug 53.

The mechanism 6, 7, 8 for moving the at least one lever 5 is connected on the one hand to the at least one lever 5 and on the other hand to the breech ring 2 and the breechblock 22. The movement mechanism 6, 7, 8 is arranged and configured to move the lever 5 to its unfolded position when the breechblock 22 is moved from its closed position to its open position during the recovery stroke of the gun 3, and to its folded up position as the end of the recovery stroke of the gun 3 approaches.

In the embodiment shown, the movement mechanism 6, 7, 8 includes an actuating member 6, a drive assembly 7 and a clutch assembly 8.

The function of the actuating member 6 is to convert, by means of the drive assembly 7, the downward movement of the breechblock 22 from its closed position to its open position into a rotational movement of the lever 5 from its folded up position to its unfolded position. To this end, the actuating member 6 is connected to the breechblock 22, in particular to the system 9 which controls the downward movement of the breechblock 22.

Advantageously, as shown schematically in FIG. 11, the system 9 for controlling the movement of the breechblock 22, in particular its downward movement, comprises a rack 90 extending along a direction parallel to the longitudinal axis A0 of the gun 3 and carried at the lower part of the breech ring 2 so as to be able to slide relative to a bearing 91 integral with the breech ring 2. A compression spring 92 is mounted around the rack 90 and is interposed between the bearing 91 and a stop 93 integral with the rack 90. The rack 90 also meshes with a first pinion 94 which in turn meshes with a second pinion 95.

During the recovery stroke, the front end AV of the rack 90 abuts against an obstacle or cam (not shown), carried by the mount of the gun 3, which moves the rack 90 rearwards AR with respect to the breech ring 2, compressing the compression spring 91. The rack 90 then pivots a lever which is, in known manner, mounted so as to pivot about a pivot pin, for example here integral in rotation with the first pinion 94, and with one end of the lever cooperating with a cam track provided in the breechblock 22, such that pivoting of the lever leads to a downward movement of the breechblock 2 to its open position where it will be held.

After a round of ammunition has been loaded, the obstacle or cam is moved, for example by a cam follower, such that it no longer opposes the rack 90, which is then caused, under the action of the compression spring 91 which expands, to move forwards AV to its initial position, thus pivoting the lever in the opposite direction and raising the breechblock 2 to the closed position.

In the embodiment shown, as it can be seen in FIG. 5, the actuating member 6 is a tubular piece that is mounted around a rotary cylinder 60 carried by the breech ring 2 and whose rotation is controlled by the control system 9 which controls the movement of the breechblock 22, the connection between the tubular piece and the rotary cylinder 60 being a sliding connection.

Considering now the system 9 for controlling the movement of the breechblock 22 that has been described above, in order to control the rotation of the rotary cylinder 60, the rack 90 is connected to the rotary cylinder 60 via the first pinion 94 and the second pinion 95, the latter being integral with the rotary cylinder 60, on the side of the rotary cylinder 60 opposite the actuating member 6. In this way, the rearward movement of the rack 90 simultaneously leads to the downward movement of the breechblock 22 and the rotation of the rotary cylinder 60 in a direction of rotation enabling the lever 5 to be moved to its unfolded position.

More specifically, the rotary cylinder 60 extends between the two cheeks 21 in the vicinity of the rear face 2A of the breech ring 2 and below the lower face 2B of the breech ring 2, i.e. below the first fixed arm 40. The rotary cylinder 60 is rotatably mounted relative to the breech ring 2. The rotary cylinder-tubular piece assembly is therefore mounted so as to be movable in rotation about the longitudinal axis A1 of the rotary cylinder 60, which is parallel to the longitudinal axes of the first 40 and second 41 arms. The actuating member 6 is mounted so as to axially slide along the rotary cylinder 60 at the end region, on lever 5 side, of the rotary cylinder 60. The rotary cylinder 60 is a slotted shaft, the protrusions 60*a* of which penetrate into complementary recesses 6*a* which are provided in the inner peripheral surface of said tubular piece and which pass through it in the longitudinal direction of the latter. The complementary shape of the protrusions 60*a* and the recesses 6*a* enables said tubular piece to move in translation along the rotary cylinder 60 while being guided by the protrusions 60*a*, but to be fixed in rotation relative to the rotary cylinder 60. Flanges 6*b* projecting toward the inside of said tubular piece, at the end of said tubular piece on the clutch assembly 8 side, make it possible to form a stop for positioning the rotary cylinder 60 in said tubular piece, the rotary cylinder 60 abutting against these flanges 6*b* in the coupling position of the clutch assembly 8, as will be described in more detail below.

The tubular piece of the actuating member 6 is a one-bloc piece comprising first 61, second 62 and third 63 connecting parts.

The first connecting part 61 is a first tubular section integral with the clutch assembly 8. In particular, the external diameter of this first tubular section is dimensioned such that the first connecting part 61 is received in a corresponding tubular section of the clutch assembly 8 and made integral therewith, in particular by screwing. This connection between the actuating member 6 and the clutch assembly 8 enables the actuating member 6 to be moved in axial translation relative to the rotary cylinder 60 by control of the clutch assembly 8.

The second connecting part 62 is a second tubular section juxtaposed to the first tubular section, with an external diameter slightly greater than the diameter of the first tubular section. This second tubular section carries, on its periphery, a tab 62*a* which extends in the same plane as the second tubular section and is orthogonal to the rotary cylinder 60. This tab 62*a* has a through hole 62*b*.

The third connecting part 63 is a third tubular section with the same external diameter as the first tubular section and juxtaposed to the second tubular section. In this way, the second tubular section is arranged between the first and third tubular sections. The external diameter of this third tubular section is dimensioned such that the third connecting part 63 is able to be received in a corresponding tubular section of the drive assembly 7 so as to be able to pivot with respect to it and also to slide toward or away from it.

One function of the drive assembly 7 is to transmit the rotational movement of the actuating member 6 to the lever 5 when the drive assembly 7 is coupled in rotation to the actuating member 6, in order to move the lever 5 from its folded up position to its unfolded position. Another function of the drive assembly 7 is also to return the lever 5 to its folded up position when the drive assembly 7 is no longer coupled in rotation to the actuating member 6.

The drive assembly 7 includes a first drive element 71 adapted to be coupled in rotation to the actuating member 6 (FIG. 6), a second drive element 72 connected to the first drive element 71 and cooperating with the lever 5, and a return means 73 connected to one of the first drive element 71 and the second drive element 72.

The first drive element 71 is mounted around the rotary cylinder 60 and around the third connecting part 63. Thus, when the third connecting part 63 is received in the first drive element 71, the first drive element 71 is mounted so as to be movable in rotation about the longitudinal axis A1 of the rotary cylinder 60, in the plane containing the lever 5, in other words in vertical alignment with the pivot pin 50.

The first drive element 71 has a tubular body from the periphery of which two pairs of tabs 71*a*, 71*b* extend radially. The two pairs of tabs 71*a*, 71*b* are diametrically opposed and each have a shaft passing through them. The second drive element 72 is rotatably mounted about the shaft carried by the first pair of tabs 71*a*. The return means 73 is connected to the so-called drive shaft 71*c* carried by the second pair of tabs 71*b*, which drive shaft 71*c* projects from the tab 71*b* on the actuating member 6 side. The diameter of the drive shaft 71*c* corresponds to the diameter of the through hole 62*b*, and the tabs 71*b* and the tab 62*a* are dimensioned such that the through hole 62*b* can be aligned with the drive shaft 71*c* and, if necessary, engaged thereon to connect in rotation the first drive element 71 and the actuating member 6, as will be explained below. The tubular body of the first drive element 71 has an internal diameter dimensioned so as to be able to receive the third connecting part 63 while allowing a translational movement of the third connecting part 63 along the slotted rotary cylinder 60 and inside the tubular body.

The second drive element 72 is connected to the first drive element 71, to the return means 73 and to the lever 5. As it can be seen in FIGS. 4 and 7, it is in the form of a connecting rod having a lower, first end 72*a* and an upper, second end 72*b*. The connecting rod extends in a vertical plane, orthogonally to the pivot pin 50 and to the first 40 and second 41 arms. The first end 72*a* of the connecting rod has a hole for the passage of the shaft carried by the first pair of tabs 71*a* of the first drive element 71. In this way, the connecting rod is rotatably mounted relative to the first drive element 71 at its first end 72*a*. The lower end region of the connecting rod has an arcuate shape to allow the connecting rod to move around the first drive element 71. The second end 72*b* of the connecting rod has an oblong hole 74 through which the lug 53 of the lever 5 extends, which oblong hole 74 is dimensioned to allow the lug 53 to slide along it. Between its first 72*a* and second 72*b* ends, the connecting rod has a locking hook 75 facing away from the breech ring 2. This locking hook 75 is configured so as to be engaged by the pin 54 of the lever 5, under the action of the springs 56, when the lever 5 is in the folded up position, in order to ensure that the device 1 is removed from the opening of the ejection hole 20. Between its first end 72*a* and the locking hook 75, the connecting rod has a hole 76 for connecting the return means 73 to the connecting rod. The thickness of the connecting rod is chosen such that it can be received in the longitudinal groove 52 of the lever 5.

The return means 73 is a spring, the two ends of which are respectively connected to the first drive element 71 and to the connecting rod 72. This spring 73 is an extension spring whose function is to bring the tabs 71*b* of the first drive element 71 closer to the connecting rod 72. Thus, when the first drive element 71 is no longer coupled in rotation to the actuating member 6, the spring 73 tends to move the first drive element 71 in rotation such that the connecting rod 72 is pulled toward the axis of the first drive element 71, and thus the lever 5 is returned to its folded up position.

Alternatively, the return means 73 could be connected to the connecting rod 72 and the breech ring 2.

One function of the clutch assembly 8 is to decouple the actuating member 6 and the drive assembly 7 when the gun 3 reaches the end of the recovery stroke, such that the movement of the drive assembly 7 and therefore of the lever 5 is no longer linked to the closing movement of the breechblock 22. Another function of the clutch assembly 8 is also to couple the actuating member 6 and the drive assembly 7, at least during the recovery stroke, such that the movement of the drive assembly 7 and therefore of the lever 5 is once again linked to the opening movement of the breechblock 22.

To this end, as it can be seen in FIGS. 3, 4 and 9, the clutch assembly 8 comprises a pushing element 80, a coupling element 81 and an intermediate element 82.

The pushing element 80 is connected on the one hand to the breech ring 2 and on the other hand to the intermediate element 82. It takes the form of a cylindrical rod supported by two supports 83 spaced apart from each other and integral with the breech ring 2, in particular by screwing. These two supports 83 each have a through hole for the rod to pass through. The rod is sized such that it can slide in the through holes. The longitudinal axis A2 of the rod is orthogonal to the pivot pin 50 and to the first 40 and second 41 arms. Thus, the sliding direction of the rod, referred to as the push direction A2, is orthogonal to the longitudinal axis of the two arms 40, 41. The two supports 83 are arranged opposite each other at the base of the breech ring 2, on the side of the cheek 21 carrying the pivot pin 50. In other words, the two supports 83 and therefore the pushing element 80 are positioned below the lower face 2B of the breech ring 2. The region of the rod which extends beyond the support 83 on the front side AV of the breech ring 2 includes a fin 80*a* extending into a corresponding groove provided in the lower face 2B of the breech ring 2, the fin 80*a* projecting on the front side AV of the breech ring 2.

A return spring 84, in particular a compression spring, is mounted around the rod between the two supports 83 so as to tend to move the pushing element 80 toward the front AV. In particular, one end of the spring 84 bears against a shoulder 80*b* of the rod located between the two supports 83 and the other end bears against the support 83 on the rear AR side of the breech ring 2. The end region of the rod opposite the region carrying the fin 80*a* has a drive finger 80*c*. The drive finger 80*c* vertically extends through an orifice made in the end region of the rod, i.e. orthogonally to the push direction A2 and to the first 40 and second 41 arms.

The coupling element 81 is connected on the one hand to the intermediate element 82 and on the other hand to the actuating member 6. The coupling element 81 includes a part 81*a* for connection to the actuating member 6 and a part 81*b* for connection to the intermediate element 82. As it can be seen in FIG. 8, the connecting part 81*a* is a tubular body mounted so as to rotate freely about the connecting part 81*b* and mounted coaxially with the rotary cylinder 60. The coupling element 81 is thus mounted so as to be movable in translation along an axis coaxial with the rotary cylinder 60. The tubular body is made integral, by screwing, to the first connecting part 61 which is received in said tubular body. The free rotation assembly enables the connecting part 81*b* to remain fixed in rotation despite rotation of the actuating member 6. The connecting part 81*b* includes a disc and a tab. The disc is housed in the tubular body of the connecting part 81*a* and is gripped between the first connecting part 61 and an inwardly directed flange formed at the end of the connecting part 81*a*. The tab is carried by the disc, perpendicular to the plane of the disc, and therefore projects from the connecting part 81*a* away from the actuating member 6. The tab extends in a horizontal plane and a follower finger 81*c* passes through it. The follower finger 81*c* vertically extends, parallel to the drive finger 80*c* and orthogonally to the translation axis of the coupling element 81.

The intermediate element 82 is connected, on the one hand, to the drive finger 80*c* of the pushing element 80 and, on the other hand, to the follower finger 81*c* of the coupling element 81. It includes a central tube 82*a* with a longitudinal axis A3 vertical and orthogonal to the push direction A2. Two pairs of tabs 82*b* extend radially from the central tube 82*a*. The two pairs of tabs 82*b* form an angle between 90 and 180 degrees with each other. The two pairs 82*b* are vertically offset from each other, in other words the two pairs 82*b* do not extend in the same horizontal plane. Each of the tabs 82*b* has an oblong hole 82*c*, the oblong holes 82*c* of two tabs 82*b* of the same pair being in vertical alignment with each other. The following finger 81*c* passes through one of the pairs of tabs 82*b* and is able to slide along the oblong holes 82*c*. The drive finger 80*c* passes through the other pair of tabs 82*b* and is able to slide along the oblong holes 82*c*, the end region of the pushing element 80 including the drive finger 80*c* being received in the space between the two tabs 82*b*.

With such an arrangement, a translational movement of the pushing element 80 in the push direction A2 toward the coupling element 81 causes the intermediate element 82 to rotate around the fingers 80*c*, 81*c* and to move along them, which causes a translational movement of the coupling element 81, and therefore of the actuating member 6, away from the drive assembly 7, until the tab 62*a* is disengaged from the drive shaft 71*c*, at which point the actuating member 6 is no longer integral in rotation with the first drive element 71 and the pushing element 80 has been moved in translation to a decoupling position. This translational movement of the pushing element 80, against the action of the spring 84, is obtained as the end of the recovery stroke approaches, by the fact that the free end of the fin 80*a*, which is located further forward than the free end of the rod of the pushing element 80, presses against a fixed support part, for example integral with the gun mount, the forces implemented for the recovery stroke of the gun 3 being greater than the elastic stress of the spring 84.

Conversely, a translational movement of the pushing element 80 in the push direction A2 away from the coupling element 81 causes the intermediate element 82 to rotate around the fingers 80*c*, 81*c* and to move along them, which causes a translational movement of the coupling element 81, and therefore of the actuating member 6, toward the drive assembly 7, until the through hole 62*b* of the tab 62*a* of the actuating member 6 is engaged on the drive shaft 71*c*, thus connecting in rotation the actuating member 6 and the first drive element 71, at which point the pushing element 80 has been moved to a coupling position. This translational movement of the pushing element 80 can be obtained by the action of the spring 84 when no more press is exerted on the fin 80*a*.

The base recovery device 1 of the invention operates as follows. When a round of ammunition is fired and the breech ring 2 recoils, the lever 5 is in the folded up position, thus the extendable structure 4 is in the non-spread out state. At the end of the recoil, the clutch assembly 8 is held in the coupling position by the action of the spring 84.

During the recovery stroke of the breech ring 2, the breechblock 22 is moved from its closed position to its open position. As the breechblock 22 moves to its open position, the system 9 for controlling the movement of the breechblock 22 causes the rotary cylinder 60, and therefore the actuating member 6, to rotate. As the actuating member 6 is coupled in rotation to the first drive element 71 via the drive shaft 71*c*, the first drive element 71 is then also driven in rotation about the rotation axis A1. As the first drive element 71 is connected to the connecting rod 72, the connecting rod 72 is in turn moved in a vertical plane and rises while being guided by the sliding of the lug 53 of the lever 5 in the oblong hole 74 of the connecting rod 72. Once the lug 53 abuts against the lower edge of the oblong hole 74, the locking hook 75 is disengaged from the pin 54, releasing the lever 5 from its folded up position. Further upward movement of the connecting rod 72 then causes the lever 5 to rotate about the pivot pin 50. The lever 5 is thus moved to its unfolded position. As the lever 5 moves, the extendable structure 4 is also unfolded to its spread out state due to the movement of the second arm 41, and the base-receiving opening 42*a* is opened until it is opposite the opening of the base ejection hole 20 at the rear AR of the breech ring 2. The various parts are dimensioned such that the extendable structure 4 is in the spread out state as soon as the breechblock 22 has been removed from the ejection hole 20. The extendable structure 4 is then maintained in the spread out state as long as the breechblock 22 is locked in the open position by a conventional extractor system. The base ejected at the end of the opening movement of the breechblock 22 passes through the base-receiving opening 42*a* and is recovered in the envelope 42 of the extendable structure 4.

As the end of the recovery stroke approaches, after ejection of the base, the pushing element 80 is displaced along the push direction A2 toward the rear AR of the breech ring 2, i.e. toward the actuating member 6, against the spring 84, for example by pressing against a fixed support with the mount part integral of the gun 3. This translational movement of the pushing element 80 then moves the coupling element 81 in translation along the axis A1 via the intermediate element 82, away from the actuating member 6. This movement of the clutch assembly 8 toward its decoupling position thus causes the actuating member 6, which is integral in translation with the coupling element 81, to be moved in translation along the axis A1 and away from the first drive element 71, until the actuating member 6 and the first drive element 71 are no longer coupled in rotation by the drive shaft 71*c*. As a result, the actuating member 6 is still rotationally indexed to the rotating cylinder 60 and therefore to the control of the movement of the breechblock 22, but the first drive element 71 is no longer linked to the control of the movement of the breechblock 22 and is therefore free to rotate independently of the angular position of the actuating member 6. The action of the return spring 73 on the first drive element 71 then allows the connecting rod 72 to be pulled downwards, which returns the to the folded up position and therefore the lever 5 extendable structure 4 to the non-spread out state. Once the lever 5 is in the folded up position, the return force of the springs 56 engages the pin 54 with the locking hook 75. The lever 5 is thus locked relative to the connecting rod 72. The passage to the chamber of the gun 3 is cleared and the gun 3 is thus ready to be loaded for firing again after the end of its recovery stroke.

Once the round of ammunition has been loaded, the breechblock 22 is moved to its closed position by the action of the spring. The control of this movement of the breechblock 22 causes the actuating member 6 to rotate so as to return the actuating member 6 to an angular position enabling it to rotatably engage the first drive element 71 after the clutch assembly 8 has moved into the coupling position, namely a position in which the through hole 62*b* in the tab 62*a* is aligned with the drive shaft 71*c*.

The movement of the clutch assembly 8 from the decoupling position to the coupling position is obtained during firing, by the action of the return spring 84 at the start of the recoil movement of the gun 3 and of the breech ring 2, said recoil releasing the pushing element 80 from said support part and therefore allowing the return spring 84 to move the pushing element 80 in translation toward the front AV of the breech ring 2.

Thus, before the end of the recoil of the breech ring 2, the actuating member 6 is again coupled to the drive assembly 7 and thus the movement of the lever 5 can again be caused by controlling the downward movement of the breechblock 22 to its open position during the subsequent recovery stroke.

It is understood that the particular embodiment just described is indicative and non-limiting, and that modifications may be made without departing from the scope of the present invention.

The invention claimed is:

1. A device for recovering ammunition bases for a gun including a breechblock movable in a breech ring between a closed position, in which the breechblock closes off a chamber, and an open position, in which said chamber is open to receive a round of ammunition, wherein said device includes:

an extendable structure that is extendable between a non-spread out state and a spread out state, the extendable structure having a base-receiving opening located opposite the chamber in the spread out state and not located opposite the chamber in the non-spread out state, the base-receiving opening being delimited by a first arm connected to the breech ring and a second arm parallel to the first arm;

at least one lever that is rotatable about a pivot pin parallel to the first and second arms and is connected to the breech ring, the at least one lever supporting the second arm; and a movement mechanism for moving the at least one lever, wherein the movement mechanism is arranged to place the at least one lever in a folded up position, in which the extendable structure is in the non-spread out state, and in an unfolded position, in which the extendable structure is in the spread out state, wherein the movement mechanism includes:

an actuating member able to be moved in translation and rotation, the rotation being controlled by a system for controlling the movement of the breechblock;

a drive assembly connected to the at least one lever and able to move the at least one lever in rotation about the pivot pin as a result of a rotation of the actuating member; and a clutch assembly carried by the breech ring and able to adopt a coupling position, in which the actuating member and the drive assembly are coupled in rotation, and a decoupling position, in which the actuating member and the drive assembly are uncoupled, the clutch assembly being arranged to be placed in the coupling position during a phase of recovery stroke of the gun, during which the breechblock is moved from the closed position to the open position, whereby the at least one lever is moved to the unfolded position by the drive assembly to enable an ejection of a base into the extendable structure in the spread out state once the breechblock is in the open position, and to be placed in the decoupling position as the end of the recovery stroke of the gun approaches, whereby the at least one movable lever is then moved to the folded up position by action of return means, independently of the movement of the breechblock.

2. The device according to claim 1, wherein the at least one lever consists of a single lever, the single lever having a distal end integral with the second arm and a proximal end connected to the pivot pin, the single lever and the second arm being perpendicular to each other.

3. The device according to claim 1, wherein the actuating member is a piece mounted so as to be movable in translation along a rotary cylinder connected to the breech ring so as to be able to rotate about a rotation axis parallel to the pivot pin, rotation of the rotary cylinder being controlled by the system for controlling the movement of the breechblock, said piece being coupled in rotation to the rotary cylinder and including:

a first connecting part connected to the clutch assembly such that said piece is movable in translation along the rotary cylinder by movement of the clutch assembly between the coupling and decoupling positions, but that a rotation of said piece about the rotation axis is not transmitted to the clutch assembly;

a second connecting part having a tab carrying a member for coupling in rotation to the drive assembly when the clutch assembly is in the coupling position; and a third connecting part around which the drive assembly is mounted so as to allow a relative rotation between the actuating member and the drive assembly when the clutch assembly is in the decoupling position.

4. The device according to claim 1, wherein the clutch assembly includes:

a pushing element connected to the breech ring and mounted so as to be movable in translation along a push direction orthogonal to a longitudinal direction of the first and second arms and parallel to a plane in which the at least one lever pivots;

a coupling element integral in translation with the actuating member; and an intermediate element connected to the pushing element and to the coupling element, and arranged to convert a translational movement of the pushing element toward the coupling element into a translational movement of the coupling element, and therefore of the actuating member, away from the drive assembly, and vice versa, the coupling element also being arranged to prevent any transmission of rotation from the actuating member to the intermediate element.

5. The device according to claim 1, wherein the drive assembly includes:

a first drive element configured to be coupled in rotation to the actuating member when the clutch assembly is in the coupling position;

a second drive element connected to the first drive element and cooperating with the at least one lever such that a rotation of the first drive element under action of the actuating member causes a rotation of the at least one lever toward the unfolded position; and the return means connected to one of the first drive element and the second drive element, and arranged such that, when the clutch assembly is in the decoupling position, the return means urges the drive elements so as to cause a rotation of the at least one lever to the folded up position.

6. The device according to claim 5, wherein the second drive element has a locking hook arranged to engage with the at least one lever when the at least one lever is in the folded up position.

7. The device according to claim 1, wherein the extendable structure has an envelope made of flexible material formed as a bag, the base-receiving opening being the only opening of the bag.

8. The device according to claim 1, wherein the first arm is fixedly mounted to the breech ring at a lower region of cheeks of the breech ring that is located below the opening of the chamber, and the second arm is positioned above the first arm and is able to be moved to an upper region of the breech ring that is located above the opening of the chamber, the first and second arms extending horizontally.

9. A large-caliber gun equipped with the device for recovering ammunition bases according to claim 1, the pivot pin of the at least one lever being positioned on a rear face of one of the cheeks of the breech ring, rotation of the actuating member being controlled by a system for controlling the movement of the breechblock and the clutch assembly being carried by the breech ring.

* * * * *